US009474380B2

(12) United States Patent
Chlapaty

(10) Patent No.: US 9,474,380 B2
(45) Date of Patent: Oct. 25, 2016

(54) HANGING COLLAPSIBLE AQUATIC CHAIR

(71) Applicant: Keith Chlapaty, Ostrander, OH (US)

(72) Inventor: Keith Chlapaty, Ostrander, OH (US)

(73) Assignee: Unit Ten, LLC, Ostrander, OH (US)

( * ) Notice: Subject to any disclaimer, the term of this patent is extended or adjusted under 35 U.S.C. 154(b) by 6 days.

(21) Appl. No.: 14/560,890

(22) Filed: Dec. 4, 2014

(65) Prior Publication Data

US 2015/0091351 A1 Apr. 2, 2015

Related U.S. Application Data

(63) Continuation-in-part of application No. 13/913,430, filed on Jun. 8, 2013.

(51) Int. Cl.
*A47C 15/00* (2006.01)
*A47C 1/14* (2006.01)

(52) U.S. Cl.
CPC ..... *A47C 15/004* (2013.01); *A47C 1/14* (2013.01)

(58) Field of Classification Search
CPC ..... A47C 1/16; A47C 1/146; A47C 5/10; A47D 1/10
USPC ..... 297/255, 16.1, 380; 4/571.1, 577.1, 4/573.1, 579
See application file for complete search history.

(56) References Cited

U.S. PATENT DOCUMENTS 1,371,715 A 3/1921 West
2,108,531 A * 2/1938 Flanders ..... A47C 1/146 297/130
2,131,219 A * 9/1938 Cooper ..... A47C 1/16 297/252
2,142,263 A 1/1939 Bentz
2,142,434 A 1/1939 Bentz
2,497,412 A 2/1950 Larin
2,624,394 A 9/1951 Milto
3,072,923 A * 1/1963 Zuke ..... A47K 3/122 4/575.1
3,288,502 A 11/1966 Romay
3,310,341 A * 3/1967 Connell ..... A47C 1/16 297/252
3,857,604 A * 12/1974 Scott ..... A47C 4/18 297/16.1
3,971,592 A 7/1976 Farley
4,221,008 A 9/1980 Nolan
4,837,869 A 6/1989 Simmon
4,850,282 A 7/1989 Postic
4,889,383 A 12/1989 Jones
4,893,363 A 1/1990 Huff
5,058,949 A 10/1991 Von Hoffman
5,067,771 A * 11/1991 Ellis ..... A47C 1/16 297/180.11

(Continued)

FOREIGN PATENT DOCUMENTS

DE 9218179 U1 * 11/1993 ..... A47C 1/146

OTHER PUBLICATIONS

CEMI, online catalog, Therapeutic Seats, http://www.cemi.it/page_details.aspx?language=en&id=101&page=Accessori.

(Continued)

*Primary Examiner* — Erin Deery
(74) *Attorney, Agent, or Firm* — Standley Law Group LLP

(57) ABSTRACT

A portable aquatic chair that is suspendible within a contained body of water such as, but not limited to, a pool or spa. The chair includes an at least partially collapsible and lightweight frame that facilitates installation and transport of the chair. During use, the chair is adapted to be supported by the containment structure of the aquatic body (e.g., by a pool deck and side wall) and to support a user in a partially submerged but seated and upright position.

14 Claims, 8 Drawing Sheets

(56) References Cited

U.S. PATENT DOCUMENTS

| | | | | |
|---|---|---|---|---|
| 5,307,527 | A | 5/1994 | Schober | |
| 5,333,322 | A | 8/1994 | Weir | |
| D351,740 | S | 10/1994 | Tesmer | |
| 5,415,455 | A | 5/1995 | Geldbaugh | |
| 5,498,054 | A | 3/1996 | Tomlinson | |
| 5,580,130 | A | 12/1996 | Williams et al. | |
| 5,825,095 | A * | 10/1998 | Albecker, III | A47C 1/143 297/25 |
| 5,857,226 | A | 1/1999 | Sommer | |
| D406,474 | S | 3/1999 | Toledo et al. | |
| 5,882,079 | A * | 3/1999 | Yang | A47C 1/146 297/228.1 |
| 5,950,256 | A | 9/1999 | Slater | |
| 6,045,423 | A | 4/2000 | Silvia | |
| 6,089,651 | A | 7/2000 | Carmen | |
| 6,179,759 | B1 | 1/2001 | Tellone | |
| 6,311,343 | B1 | 11/2001 | Wisniewski | |
| 6,637,045 | B1 | 10/2003 | Larsen | |
| 6,739,643 | B1 | 5/2004 | Rock et al. | |
| 6,783,181 | B2 | 8/2004 | Scheurer et al. | |
| 7,316,452 | B2 | 1/2008 | Vestweber | |
| 7,607,724 | B2 * | 10/2009 | Dickie | B62B 7/06 297/16.1 |
| 8,240,760 | B2 | 8/2012 | Scheurer et al. | |
| 8,783,765 | B1 | 7/2014 | Matus et al. | |
| 2008/0092285 | A1 | 4/2008 | Petersen | |
| 2008/0093895 | A1 | 4/2008 | Deckert | |
| 2011/0099708 | A1 | 5/2011 | Freedman | |
| 2013/0031712 | A1 | 2/2013 | Gossett et al. | |

OTHER PUBLICATIONS

Sprint Aquatics, online catalog, Pool Side Chair, http://www.sprintaquatics.com.

* cited by examiner

HANGING COLLAPSIBLE AQUATIC CHAIR

CROSS-REFERENCE TO RELATED APPLICATIONS

This application is a continuation-in-part of U.S. application Ser. No. 13/913,430, filed on Jun. 8, 2013, now U.S. Pat. No. 9,212,497.

TECHNICAL FIELD

Embodiments of the invention are directed to chairs that are suspendible within a contained body of water such as, but not limited to, a pool or spa.

BACKGROUND

People frequently utilize swimming pools, spas and/or other aquatic bodies as a form of recreation, exercise, relaxation, or therapeutic enjoyment. Pools and/or spas can be found at many health clubs, recreation centers and rehabilitation centers, as well as in private homes. It is estimated that there are approximately 11 million public and private pools within the United States alone.

Many users utilize aquatic accessories to enhance their recreational swimming experience, and there is a vast array of such aquatic accessories available commercially. One popular and generally familiar form of aquatic accessory comes in the form of a floatation device, such as for instance, an inflatable raft or floating chair. Such devices enable a user to reside in a lying or sitting position while floating or being partially submerged within the water of an aquatic body. While certainly useful and enjoyable to many, inflatable rafts must be inflated before use and typically cannot support a user in a seated position. Floating chairs are typically quite bulky and heavy. Additionally, both of these devices generally require some degree of effort, if not contortion, to mount once the user and the device are both in the water.

Another type of aquatic accessory—and one more relevant to the present invention—is an aquatic chair. In contrast to a flotation-type aquatic accessory that relies on the buoyancy of the device to support a user in the water, an aquatic chair is supported by the structure containing the aquatic body. For example, an aquatic chair may be cooperatively supported by the deck and wall of a swimming pool or spa. An aquatic chair supports a user in a similar but generally more upright and fixed position than a floating chair. Typical aquatic chairs are designed to support a user in a substantially submerged position, but with the user's head and a portion of the torso above the water surface. While also useful, known aquatic chairs tend to be bulky, and often must be affixed to the side and deck of aquatic body containment structure in order to securely support a user.

While it can be understood that aquatic accessories such as aquatic chairs exist, it should also be realized that most users would prefer to minimize the effort involved with the setup and use of such chairs. This is particularly true if the user is elderly and/or has a physical disability. Furthermore, most users would also prefer an aquatic chair that is compact and easy to transport. To that end, there is a need for a lightweight aquatic chair that is easy to store, transport, setup, and utilize, while still providing proper support and security to a user.

SUMMARY

Aquatic chair embodiments of the invention meet the aforementioned needs and desires of users. That is, aquatic chair embodiments of the invention are lightweight, compact, and easy to transport and set up, while still securely supporting a user in a seated and partially submerged position within an aquatic body. Aquatic chair embodiments of the invention may be at least partially collapsible to minimize required storage space and facilitate transport.

Aquatic chair embodiments of the invention utilize an existing aquatic body containment structure for suspension of a user within the aquatic body. For example, an aquatic chair of the invention may be cooperatively supported by the deck and wall of a pool or spa. No permanent affixation is required in order for an aquatic chair of the invention to remain securely in place while being mounted by or supporting a user. Likewise, no additional fastening or retention devices are required to secure an aquatic chair embodiment of the invention within an aquatic body. The framework of the chair itself adequately secures the chair and supports the user.

An aquatic chair embodiment in accordance with the invention includes a tubular main frame to which is connected a tubular seat frame and a tubular hanging frame. Preferably, the seat frame and the hanging frame are pivotally connected to the main frame, thereby rendering the aquatic chair at least partially collapsible. This feature allows the aquatic chair to fold up into a compact and flat configuration, which presents a reduced profile that facilitates transportation and storage.

A section of fabric or other suitable material may be secured between opposing tubular portions of the seat frame so as to provide a seat for supporting a user. Support straps may extend between the seat frame and the main frame to limit the range of extension of the seat frame and to transfer at least some of the weight of a user to the main frame and hanging frame.

In some aquatic chair embodiments, the main frame may be length adjustable to accommodate users of different heights and to position said users at a proper level of submersion. In other embodiments, users of different sizes may be accommodated and properly supported by altering the size of at least the main frame so as to produce aquatic chairs of different sizes.

In any of various possible configurations, an aquatic chair according to the invention will be supported by an upper bounding surface and side wall of an aquatic body containment structure. In the case of using an aquatic chair of the invention in a swimming pool, for example, the hanging frame of the aquatic chair extends over a portion of the pool deck or coping when the chair is submerged, while a rearward portion of the seat frame contacts the pool wall. Consequently, the chair resides in a suspended and partially submerged position within the pool when installed properly thereto. A similar arrangement may be accomplished in a spa of sufficient size. Likewise, an aquatic chair of the invention may be suspended in any aquatic body having an upper bounding surface (e.g., deck, shore, etc.) and a side wall that can collectively support the chair as described above.

Because the submerged depth of the seat is determined substantially by the length of the main frame, and because an aquatic chair according to the invention is supported by the upper bounding surface and side wall of an aquatic body containment structure instead of the bottom wall thereof, a user can always be positioned at a properly submerged level. Consequently, aquatic chair embodiments of the invention may be used in an aquatic body of any surface area or depth without the need to make any adjustments thereto, or by making only minor length adjustments to the main frame.

When properly positioned within an aquatic body, an aquatic chair of the invention will support a user in a stable, upright, and partially submerged position. Aquatic chair embodiments may be used for recreational purposes, such as to cool off in a swimming pool while remaining stationary and without having to stand or float. Aquatic chair embodiments may also be used during swimming lessons to provide for water safety. Aquatic chair embodiments may further be used therapeutically, such as in rehabilitation programs that involve in-water exercises. Similarly, aquatic chair embodiments may be used to support disabled users—particularly those without sufficient strength or motor skills to stand, float, tread water, etc. In the case of therapy or a disabled user, for example, a safety strap or similar device may be added to ensure that a user remains upright and does not slip off the seat.

An aquatic chair embodiment may include one or more of various other options—which may or may not be related to the type of use to which the chair will be subjected. For example, and without limitation, an aquatic chair embodiment may include sun protection, comfort accessories such as arm, foot and/or head rests, storage compartments, audio and/or video supports or connections, food and/or drink retention or support, and a beverage cooler.

Other aspects and features of the invention will become apparent to those of skill in the art upon review of the following detailed description of exemplary embodiments along with the accompanying drawing figures.

BRIEF DESCRIPTION OF THE DRAWINGS

In the following descriptions of the drawings and exemplary embodiments, like reference numerals across the several views refer to identical or equivalent features, and.

DETAILED DESCRIPTION OF THE EXEMPLARY EMBODIMENT(S)

Figure 1:
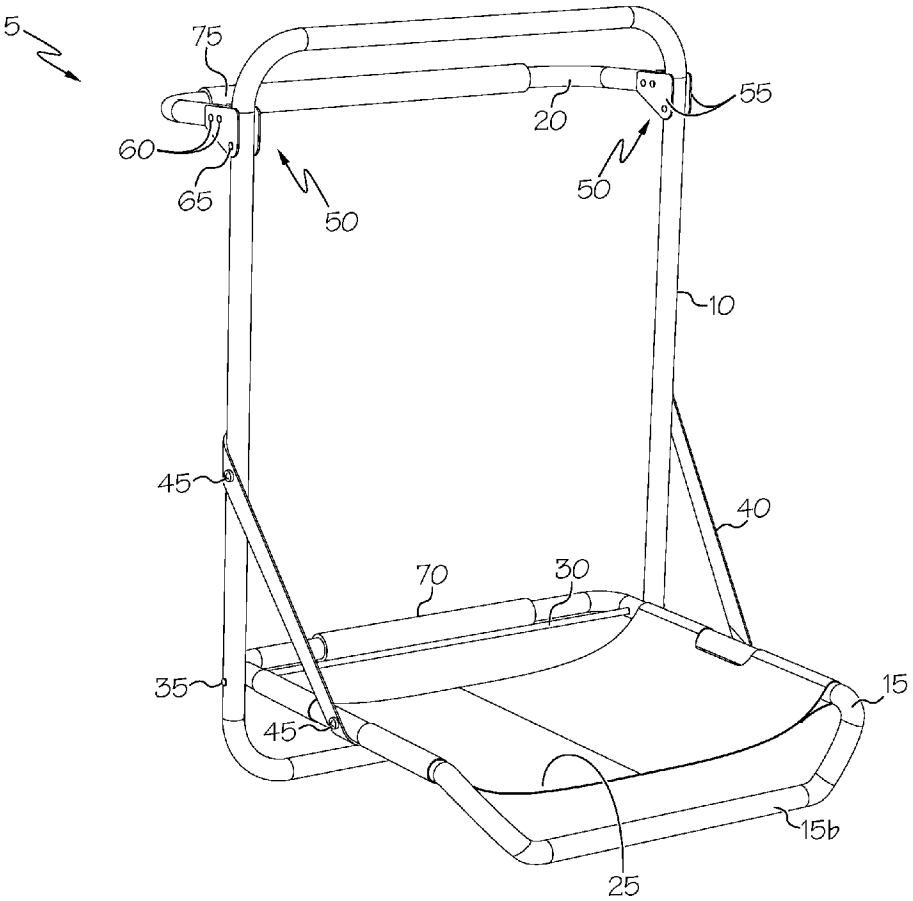
FIG. 1 is a perspective view of one exemplary embodiment of an assembled aquatic chair according to the invention.
Figure 2A:
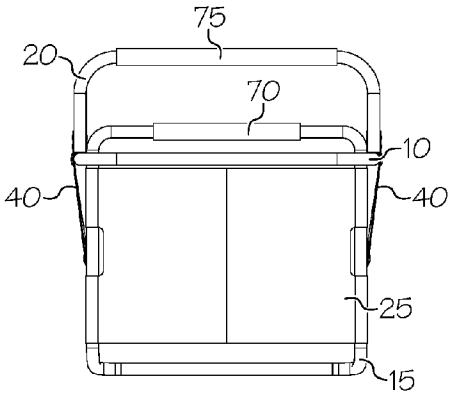
FIG. 2A is a top view of the exemplary aquatic chair embodiment shown in FIG. 1.
Figure 2B:
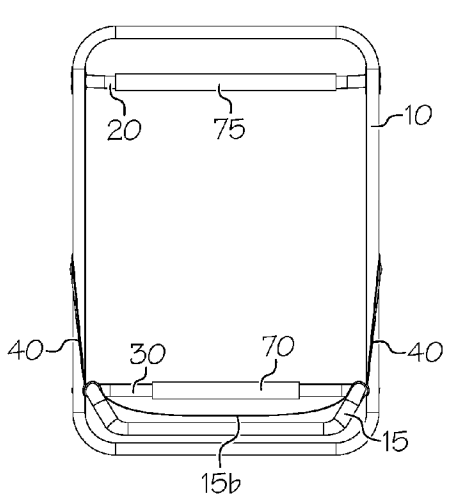
FIG. 2B is a front view of the exemplary aquatic chair embodiment shown in FIG. 1.
Figure 2C:
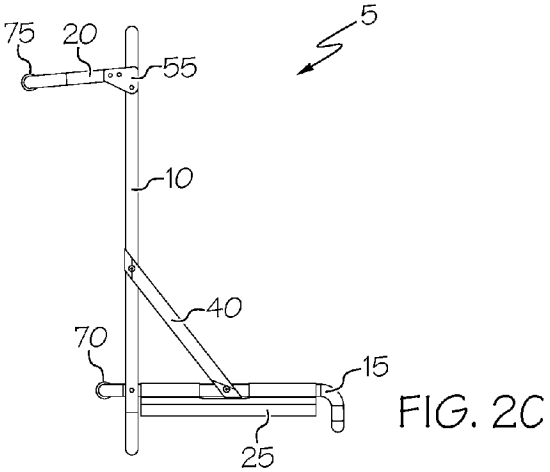
FIG. 2C is a side view of the exemplary aquatic chair embodiment shown in FIG. 1.

One exemplary embodiment of an aquatic chair 5 is depicted in FIGS. 1-4. As shown, the chair 5 is an assembly comprised primarily of a main frame 10, a seat frame 15, and a hanging frame 20. The seat frame 15 is pivotally connected to the main frame 10 near a distal end thereof. The hanging frame 20 is pivotally connected to the main frame 10 near a proximal end thereof. A seat 25 is associated with the seat frame 15.

The main frame 10 is a continuous tubular structure. In this exemplary embodiment, the main frame 10 is of substantially rectangular perimetric shape, but other shapes may be possible. In this exemplary embodiment, the main frame 10 is also substantially planar, which facilitates manufacturing.

The seat frame 15 is also a continuous tubular structure. In this exemplary embodiment, the seat frame 15 is of substantially square perimetric shape, but other shapes may be possible. The seat frame 15 may also be planar in some embodiments, but in this exemplary embodiment, a front section of the seat frame is non-planar. More specifically, the seat frame 15 includes a lowered front portion 15*b* that forms a leg recess for facilitating user comfort during use of the chair 5.

Like the main frame 10 and the seat frame 15, the hanging frame 20 is also a tubular structure. However, unlike the other frames 10, 15, the hanging frame 20 of this exemplary embodiment is open on one side. More particularly, the hanging frame 20 includes a long (support) leg 20*a* and two short (connecting) legs 20*b* that extend from opposite ends of the long leg, such that the hanging frame is of generally an elongated "C" shape. Each of the connecting legs 20*b* includes a free end for use in attaching the hanging frame 20 to the main frame 10. Like the main frame 10, this exemplary embodiment of the hanging frame 20 is substantially planar.

A seat 25 is affixed to the seat frame 15. In this exemplary embodiment, the seat 25 is shown to be a section of material such as fabric, canvas, vinyl or some other similar material. Such materials may be substantially porous to water, which facilitates drying of the seat 25 and may also allow the seat frame 15 to be more easily lowered and raised while submerged due to decreased water resistance.

As shown, this particular seat 25 is affixed to the seat frame 15 by looped ends through which the tubing of the seat frame passes. The looped ends may be closed by stitching or by any other closure means known in the art. In other embodiments employing a similar seat material, the seat 25 may be affixed to the seat frame 15 by other than looped ends. For example, fasteners may be passed through the seat material and into the seat frame, the seat material may be bonded to the seat frame, etc.

Other seat types and seat materials may be utilized in other aquatic chair embodiments. For example, a rigid or semi-rigid plastic seat may be attached to the seat frame 15 in lieu of the fabric or similar material seat described above. Likewise, the seat 25 may be comprised of wood, metal (e.g., aluminum), a composite material, etc., and may be appropriately attached to the seat frame 15. The seat material ultimately selected may depend on a number of factors such as, but not limited to, cost, weight, user comfort, durability, reactivity with water, etc.

Preferably, but not essentially, each of the main frame 10, seat frame 15, and hanging frame 20 is comprised of a continuous, bent tubular material. For example, as shown in the drawing figures, each of the main frame 10 and seat frame 15 is CNC continuous bent, welded at the seam, and subsequently anodized. The hanging frame 20 may be similarly bent, but does not need to be welded due to its open design.

As can be understood from the foregoing description, the frame material may be metallic in nature. When a metallic material is used, a metal may be selected that will not react adversely with water and/or chemicals that may be present therein, for example, the chemicals typically present in pool and spa water. Alternatively, or additionally, the metal material may be coated (e.g., painted, anodized, etc.) or otherwise treated so as to be non-reactive or substantially non-reactive with the water in which the aquatic chair will be submerged.

In alternative embodiments, the frame portion of an aquatic chair may be comprised of a non-metallic material such as, for example, plastic, Kevlar, a composite, etc. One such suitable but non-limiting plastic material may be polyvinyl chloride (PVC).

Whether metallic or non-metallic materials are used, each frame of the aquatic chair 5 is preferably provided as a substantially unitary structure—whether through forming or by continuously bending a length of existing tubing and welding, bonding or otherwise affixing the seam. Nonetheless, it may also be possible to form the various frames of an aquatic chair embodiment from individual sections of tubing that are welded, bonded, or otherwise joined together, or for one, two or all of the individual frames to be open at one end (i.e., non-continuous).

The use of round tubing facilitates frame manufacturing and also eliminates any corners that might cause user discomfort. Nonetheless, the use of frame tubing having other (non-round) cross-sectional areas is also possible.

Selection of a frame material may be governed by one or a number of factors such as, the environment within which the aquatic chair will be used, the nature of its use, the type of user or users that may use the chair, and the weight of said user(s). Material selection may further consider the weight of the chair and the importance of ease of transportability, etc. In any case, it should be realized that the material used to form the frame assembly of an aquatic chair embodiment may be largely a matter of design choice based on the particular environment within which the chair will be used.

As can be best observed in FIG. 1, both the seat frame 15 and the hanging frame 20 of this exemplary embodiment are pivotally attached to the main frame 10, which permits the rotation of the seat frame and the hanging frame towards and against or within the main frame. Consequently, the seat frame 15 of the aquatic chair 5 may be collapsed or folded in a manner that greatly reduces its profile. This collapsing feature is beneficial at least with respect to transporting, carrying and storing the aquatic chair 5. Likewise, installation of the aquatic chair 5 into an aquatic body may also be facilitated by the collapsing nature of the seat frame 15.

In this exemplary embodiment, the pivotal (hinged) connection of the seat frame 15 to the main frame 10 is accomplished by means of an elongate hinge rod 30 that passes through opposing tubes of the main frame 10 and opposing tubes of the seat frame 15, thereby pivotally trapping the seat frame within the main frame. In other embodiments, the main frame 10 may instead be similarly trapped within the seat frame 15.

The hinge rod 30 may be retained in the frames 10, 15 by any means known in the art, including without limitation, spring clips, cotter pins, and bulging of the rod ends. Alternatively, all or just the ends (as shown) of the hinge rod 30 may be threaded so as to receive a cap nut 35 or similar fastener that will prevent unwanted lateral movement of the hinge rod without hindering or preventing rotation of the seat frame 15.

In other exemplary embodiments, the common hinge rod 30 may be replaced with two individual hinge elements; one at each main frame—seat frame interface. Such hinge elements may include, for example, captive hinge pins, shoulder bolts and nuts, etc.

Because the seat frame 15 and seat 25 support the weight of a user when the aquatic chair 5 is in use, rotation of the seat frame in a downward direction must be limited. Rotation is likely to be limited in most embodiments to a seat frame-to-main frame angle of 90 degrees or less, such that a user will not have a tendency to slide off the seat 25. Nonetheless, seat frame-to-main frame angles of greater than 90 degrees are also within the scope of the invention.

In this exemplary embodiment of the aquatic chair 5, downward rotation of the seat frame 15 is limited by a pair of seat support straps 40 that extend between and are fastened to the main frame 10 and the seat frame 15. One strap resides on either of opposing sides of the main frame 10 and seat frame 15, as is clearly shown in FIG. 1. The support straps 40 do not inhibit an upward rotation of the seat frame 15 (such as when collapsing the chair 5), but limit downward rotation of the seat frame to some predetermined and acceptable seat frame-to-main frame angle. The use of other seat rotation limiting mechanisms are possible in other embodiments (see e.g., FIGS. 8A-8C).

Figure 3:
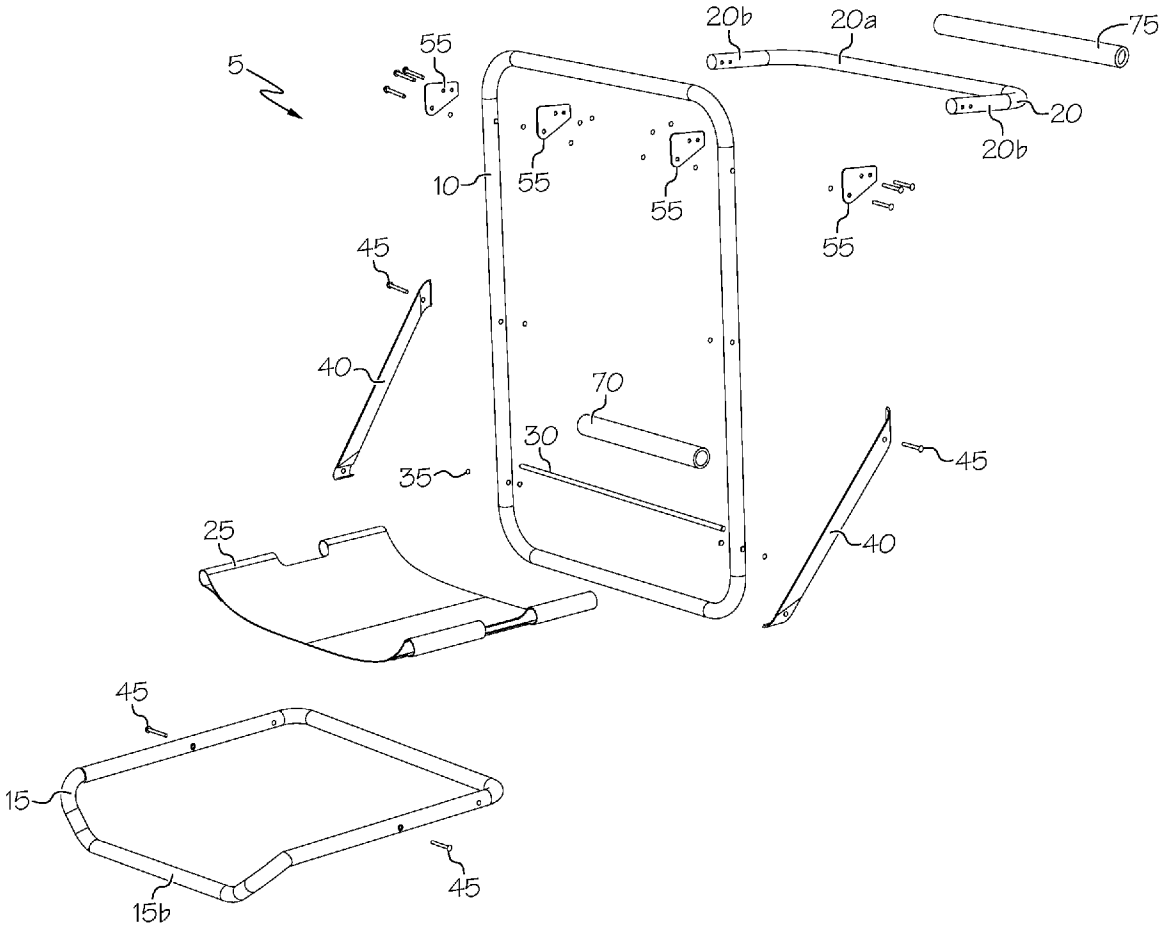
FIG. 3 is an exploded view of the exemplary aquatic chair embodiment shown in FIG. 1.

The support straps 40 may be comprised of nylon or any number of strong and substantially non-stretchable materials. Preferably, the selected strap material is not unacceptably degraded by exposure to water or to the chemicals typically found in pool or spa water. The support straps 40 may be looped over the tubing of the main frame 10 and seat frame 15 and prevented in some manner from sliding thereon. Alternatively, and as indicated in FIG. 3, the support straps 40 may be secured to the main frame 10 and seat frame 15 by fasteners 45 that pass through the straps and into the frames.

The hanging frame 20 is also pivotally connected to the main frame 10, as is best shown in FIG. 1. In this exemplary embodiment, each free end of the connecting legs 20*b* of the hanging frame 20 is pivotally connected to the main frame 10 by a corresponding gusset assembly 50. Each gusset assembly includes a pair of cooperating gusset plates 55. Referring still to FIG. 1, it can be observed that the gusset plates 55 of each gusset assembly 50 are spaced apart and arranged so as to trap a tube of the main frame 10 and a free end of the hanging frame 20 therebetween. Preferably, the gusset plates 55 make contact with points on the main frame tube and with points on the free ends of the hanging frame tube that are substantially diametrically opposed.

One end of each gusset plate 55 of a given gusset plate assembly 50 is attached by a pair of fastener assemblies 60 to an associated connecting leg 20*b* of the hanging frame 20. An opposite end of each gusset plate 55 of a given gusset plate assembly 50 is attached by a single fastener assembly 65 to the main frame 10. The use of a pair of fastener assemblies 60 to secure the hanging frame 20 to the gusset plates 55 prevents rotation of the hanging frame within the gusset plates. In contrast, the use of a single fastener assembly 65 to secure each gusset plate assembly 50 to the main frame 10 allows rotation of the hanging frame 20 and gusset plate assemblies about the main frame.

As should be understood from the foregoing description and the drawing figures, the majority of the weight of a user is supported by the hanging frame 20 when the aquatic chair 5 is in use. Therefore, in a manner similar to that of the seat frame 15, the angle of rotation between the hanging frame 20 and the main frame 10 is limited. More specifically, the upward angle of rotation between the hanging frame 20 and the main frame 10 is limited such that the hanging frame may rest on and support the aquatic chair 5 from an upper bounding surface such as a pool or spa deck or edge coping.

Generally speaking, rotation is likely to be limited in most embodiments to a hanging frame-to-main frame angle of around 90 degrees. For example, in this particular embodiment, the hanging frame-to-main frame angle is limited to 95 degrees. Nonetheless, other hanging frame-to-main frame angles may also be used as long as an aquatic chair embodiment may be adequately and securely supported within an aquatic body.

Figure 4:
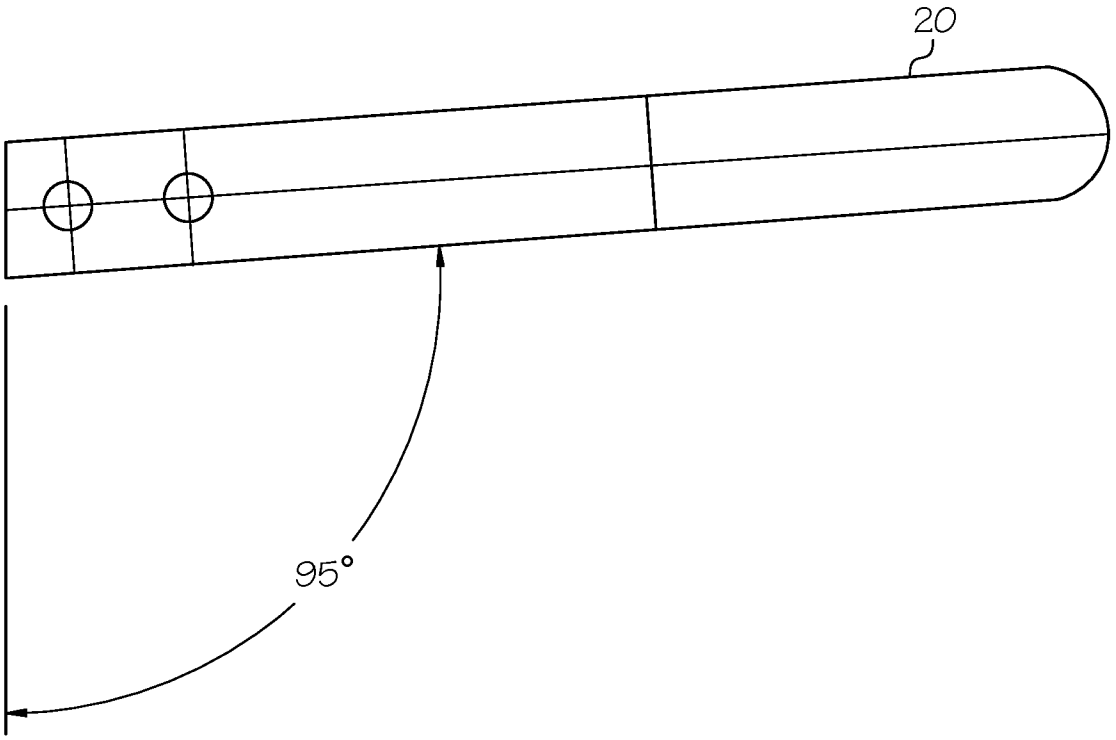
FIG. 4 is an enlarged side view of a hanging frame portion of the exemplary aquatic chair embodiment shown in FIG. 1.

The technique used to limit the upward angle of rotation of the hanging frame 20 in this exemplary embodiment of the aquatic chair 5 may be better understood by reference to FIG. 4, where an enlarged side view of the hanging frame 20 is depicted. As shown, the free end of each of the short legs 20*b* of the hanging frame is cut at an angle of 95 degrees (i.e., 5 degrees to the vertical). Consequently, when the hanging frame 20 is rotated upward along with the gusset assemblies 50, the angled free ends of the connecting legs 20*b* of the hanging frame 20 will eventually come into contact with the corresponding tubular members of the hanging frame 10 to which the gusset assemblies are attached. The angle at which the free ends of the connecting legs 20*b* of the hanging frame 20 are cut serves as the limit to the hanging frame-to-main frame angle. In this case, the hanging frame-to-main frame angle is thereby limited to no more than 95 degrees—which corresponds to a hanging frame-to-support surface (e.g., pool deck) angle of no more than 5 degrees.

In contrast to the limited upward angle of rotation of the hanging frame 20, the hanging frame may be rotated downward until it is collapsed against the main frame 10. Consequently, the hanging frame 20 of the aquatic chair 5 may be collapsed or folded in a manner that greatly reduces its profile. This collapsing feature is beneficial at least with respect to transporting, carrying and storing the aquatic chair 5. Likewise, installation of the aquatic chair 5 into an aquatic body may also be facilitated by the collapsing nature of the hanging frame 20.

One or both of the seat frame 15 and the hanging frame 20 may include a contact element. Such a contact element may serve several purposes, including for example, preventing the support structure of the aquatic body from being scratched or otherwise damaged by direct contact with the frame material, and/or providing a higher degree of frictional contact so as to help the aquatic chair remain in place once installed to an aquatic body.

In this exemplary embodiment, a seat frame contact element 70 is located along a rear tube of the seat frame 15, and a hanging frame contact element 75 is located along the support tube 20*a* of the hanging frame 20. The particular contact elements 70, 75 shown here are ethylene propylene diene monomer (EPDM) foam rubber tubes through which the corresponding tubular sections of the seat frame 15 and hanging frame 20 are respectively passed prior to affixation to the main frame 10. One of skill in the art would understand that contact elements of other designs and compositions may be used in other embodiments.

Figure 5:
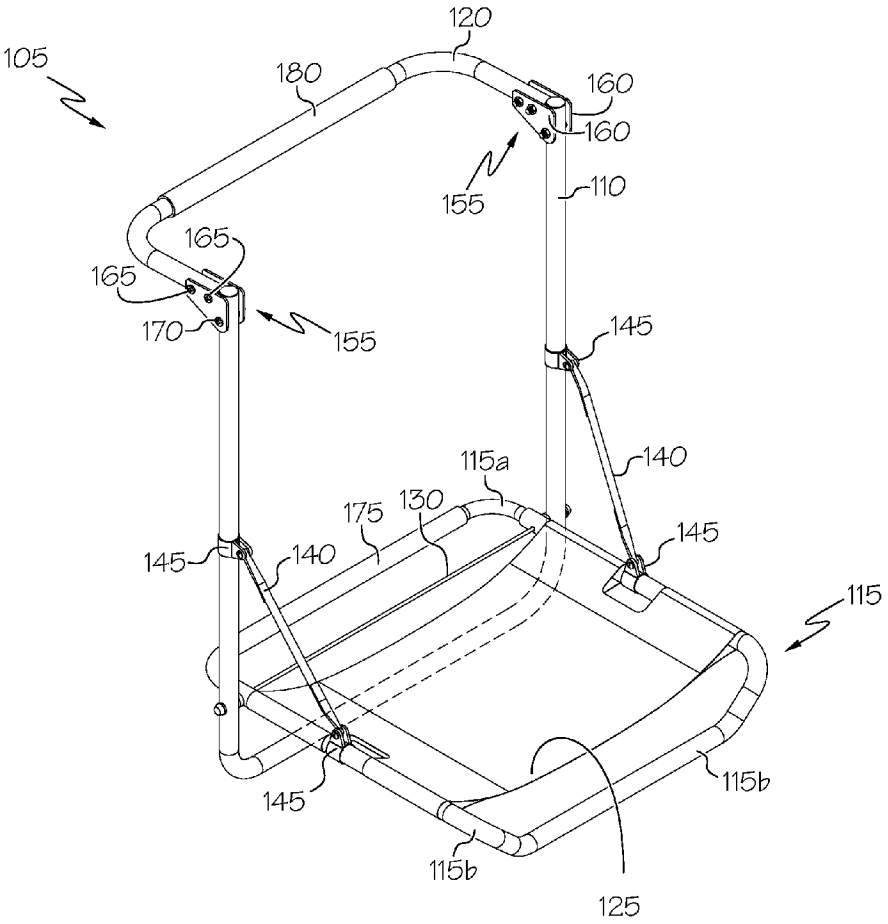
FIG. 5 is a perspective view of another exemplary embodiment of an assembled aquatic chair according to the invention.
Figure 6:
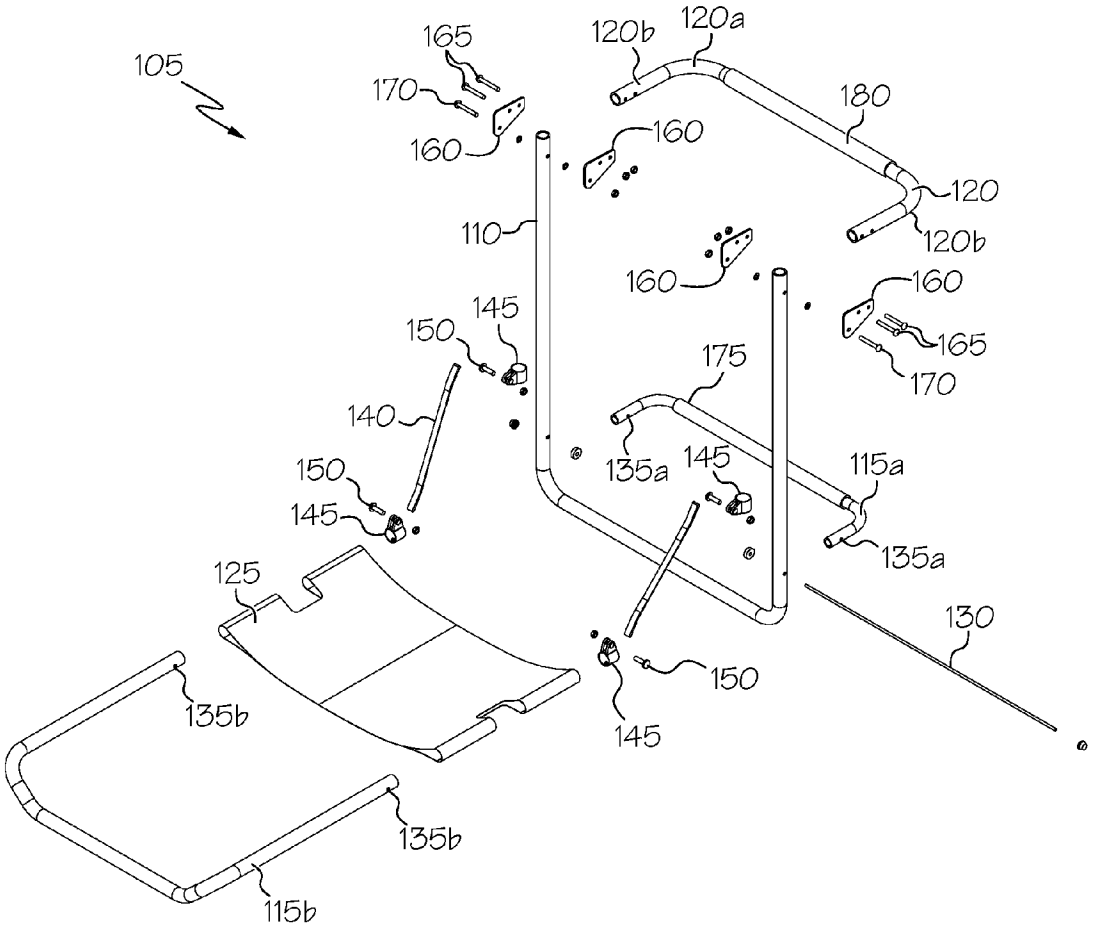
FIG. 6 is an exploded view of the exemplary aquatic chair embodiment shown in FIG. 5.

Another exemplary embodiment of an aquatic chair 105 is depicted in FIGS. 5-6. This embodiment of the aquatic chair 105 is very similar to the exemplary aquatic chair 5 shown in FIGS. 1-4 and described above. Consequently, all of the materials, shapes, cross-sectional shapes, affixation techniques, methods of installation and operation, etc., associated with the aquatic chair 5 or any component of the aquatic chair of FIGS. 1-4, is also applicable to the embodiment of the aquatic chair 105 depicted in FIGS. 5-6 and described in detail below. While the aquatic chair 105 of FIGS. 5-6 is very similar to the aquatic chair of FIGS. 1-4, the aquatic chair of FIGS. 5-6 has been even further optimized with respect to manufacturing costs and weight.

As shown, the chair 105 again takes the form of an assembly comprised primarily of a main frame 110, a seat frame 115, and a hanging frame 120—with the seat frame 115 pivotally connected to the main frame 110 near a distal end thereof and the hanging frame 120 pivotally connected to the main frame 110 near a proximal end thereof. A seat 125 is again associated with the seat frame 115.

In this exemplary embodiment, the main frame 110 is not a continuous, seam-welded, tubular structure as in the embodiment of FIGS. 1-4. Rather, in this exemplary embodiment, the main frame 110 is a bent and substantially U-shaped tubular structure—meaning that the main frame 110 is open at one end. In this case, the open end of the main frame 110 is the proximal (upper) end. Eliminating one leg of the main frame 110 reduces the amount of material required to produce the main frame and also eliminates the need for a seam weld. Consequently, the main frame 110 of this exemplary embodiment of an aquatic chair 105 costs less to manufacture and weighs less than the main frame 10 of FIGS. 1-4. The main frame 110 is again substantially planar, which further facilitates manufacturing.

As with the main frame 110, the seat frame 115 of this exemplary aquatic chair 105 is also not a continuous tubular structure. Rather, the seat frame 115 is an assembly comprised of a rear seat frame section 115*a* and a forward seat frame section 115*b*. In this particular example, the rear seat frame section 115*a* is of substantially a truncated "U" shape, while the rear seat frame section 115*a* is of substantially a "U" shape. As can be observed in FIG. 6, the rear seat frame section 115*a* and forward seat frame section 115*b* are designed such that the free ends of one section fit into the free ends of the other section so as to form a continuous tubular structure when so assembled. As with the seat frame 15 of FIGS. 1-4, the seat frame 115 of this embodiment is again of substantially square perimetric shape. The precise shape of each seat frame section 115*a*, 115*b*, and of the assembled seat frame, may be different in other aquatic chair embodiments.

This embodiment of the seat frame 115 may also be planar when assembled. However, as with the seat frame 15 of FIGS. 1-4, this exemplary seat frame embodiment 115 includes a downwardly bent portion along the front of the seat frame that forms a leg recess for facilitating user comfort during use of the aquatic chair 105.

The hanging frame 120 of this exemplary aquatic chair 105 is substantially the same as the hanging frame 20 shown in FIGS. 1-4 and, therefore, includes a long (support) leg 120*a* and two short (connecting) legs 120*b* that extend from opposite ends of the long leg, such that the hanging frame is again of generally an elongated "C" shape. Each of the connecting legs 120*b* again includes a free end for use in attaching the hanging frame 120 to the main frame 110. This exemplary embodiment of the hanging frame 120 is also substantially planar.

A seat 125 is affixed to the seat frame 115. In substantially the same manner as described above with respect to the aquatic chair 5 of FIGS. 1-4. The seat 125 may be comprised of any of the materials described above with respect to the seat 25 and may also be attached to the seat frame 115 in any matter mentioned above.

As with the aquatic chair 5 of FIGS. 1-4, both the seat frame 115 and the hanging frame 120 of this exemplary aquatic chair 105 are pivotally attached to the main frame 110. This once again permits rotation of the seat frame and the hanging frame towards and against or within the main frame, and allows the aquatic chair 105 to be collapsed or folded in a manner that greatly reduces its profile.

In this exemplary embodiment of the aquatic chair 105, pivotal (hinged) connection of the seat frame 115 to the main frame 110 is again accomplished by means of an elongate hinge rod 130 that passes through opposing tubes of the main frame 110 and opposing tubes of the seat frame 115, thereby pivotally trapping the seat frame within the main frame. With respect to the seat frame 115, the hinge rod 130 is passed through corresponding holes 135*a*, 135*b* in the free ends of both the rear seat frame section 115*a* and forward seat frame section 115*b* after said sections have been assembled to one another, so as to lock the rear seat frame section 115*a* to the forward seat frame section 115*b* in addition to forming the pivot axis of the seat 115.

In other exemplary embodiments, the main frame 110 may instead be similarly trapped within the seat frame 115. In other exemplary embodiments, the common hinge rod 130 may be replaced with two individual hinge elements; one at each main frame—seat frame interface. Such hinge elements may include, for example, captive hinge pins, shoulder bolts and nuts, etc.

Rotation of the seat frame 115 in a downward direction is again limited in this aquatic chair embodiment 105 by a pair of seat support straps 140 that reside on opposing sides of the main frame 110 and extend between and are fastened to the main frame 110 and the seat frame 115. In this embodiment, opposite ends of the support straps 140 are respectively attached to the tubing of the main frame 110 and forward seat frame section 115*b* by way of strap attachment collars 145 and associated fasteners 150. The strap attachment collars 145 respectively encircle the tubing of the main frame 110 and the seat frame 115 and are clamped tightly thereto by said fasteners 190. The seat frame-to-main frame angle of rotation may be limited as described above with respect to the exemplary aquatic chair embodiment of FIGS. 1-4.

The hanging frame 120 is pivotally connected to the main frame 110 in the same manner as described above with respect to the exemplary aquatic chair embodiment of FIGS. 1-4. Therefore, a gusset assembly 155 comprising a pair of gusset plates 160 and associated fasteners 165, 170 is again provided to pivotally couple each free end of the connecting legs 120*b* of the hanging frame 120 to the main frame 110. Rotation of the hanging frame 120 and gusset plate assemblies 155 about the main frame 110 also occurs as discussed above with respect to the exemplary aquatic chair embodiment of FIGS. 1-4.

The upward angle of rotation between the hanging frame 120 and the main frame 110 is also limited by contact between the hanging frame 120 and the main frame 110 in the same manner as described above with respect to the exemplary aquatic chair embodiment of FIGS. 1-4. Consequently, the hanging frame 120 may rest on and support the aquatic chair 115 from an upper bounding surface of an aquatic body, such as a pool or spa deck or edge coping. The hanging frame-to-main frame angle limit may be as described above with respect to the exemplary aquatic chair embodiment of FIGS. 1-4. The hanging frame 120 may again be rotated downward until it is collapsed against the main frame 110.

One or both of the seat frame 115 and the hanging frame 120 may include a contact element as described above. The contact element(s) may be provided for the same or similar purposes and may be of the same or similar construction as the contact elements described above. In this exemplary embodiment, a seat frame contact element 175 is located along a rear tube of the rear seat frame section 115*a*, and a hanging frame contact element 180 is located along the support tube 120*a* of the hanging frame 120.

Figure 7:
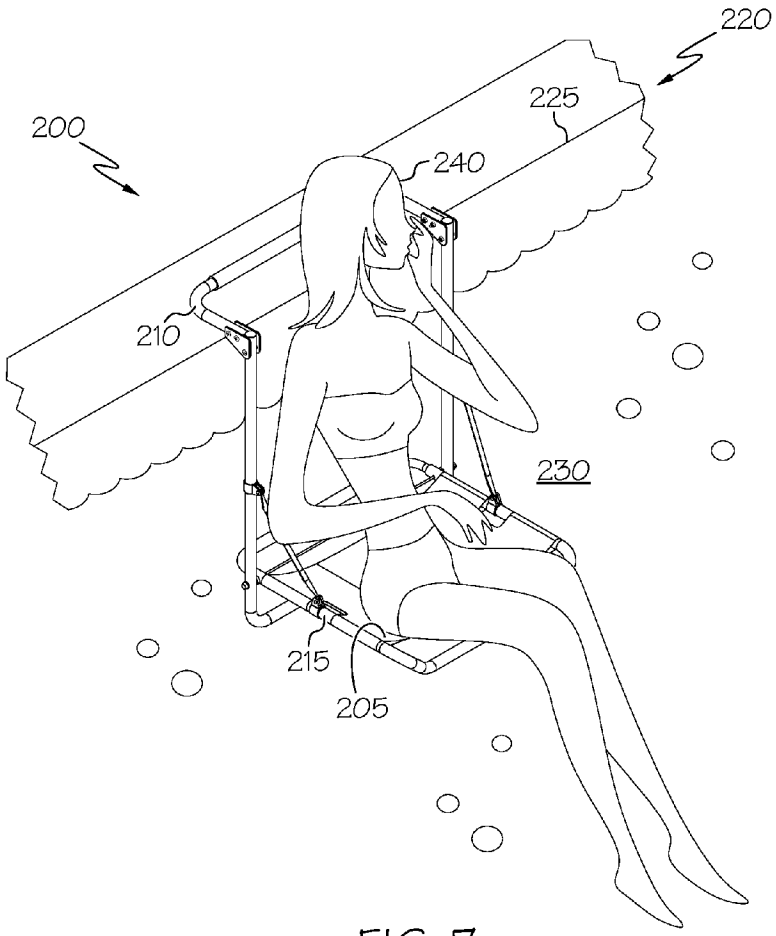
FIG. 7 represents a user being suspended by an exemplary aquatic chair embodiment of the invention in a partially submerged position within an aquatic body.

Use of an exemplary aquatic chair 200 according to the invention is depicted in FIG. 7. As shown in this example, the aquatic chair 200 is suspended within the water of a pool 220 and a user 240 resides on the seat 205 of the chair. As can be observed, the aquatic chair 200 and the user 240 are supported in a partially submerged position by the hanging frame 210 of the aquatic chair 200, which is resting on and being supported by the pool deck 225, and by contact of the rear of the seat frame 215 with the side wall 230 of the pool 220. The hanging frame 210 and pool deck 225 support the substantially normal (vertically oriented) forces associated with the weight of the user, while some percentage of the user's weight is conveyed to the wall 230 of the pool by the seat frame 215.

When the user is finished using the aquatic chair 200, the light weight of the chair allows it to be easily removed from the water. Once removed from the water, the collapsing nature of the seat frame 215 and the hanging frame 210 allow the aquatic chair 200 to be folded into a compact and easy to transport package. Alternatively, the seat frame 215 may be collapsed against the main frame 210 while the aquatic chair remains in the water, which may facilitate subsequent removal of the aquatic chair due to decreased water resistance. In this case, a simple seat frame retention element may be provided to temporarily secure the seat frame 215 to the main frame 210.

Figure 8C:
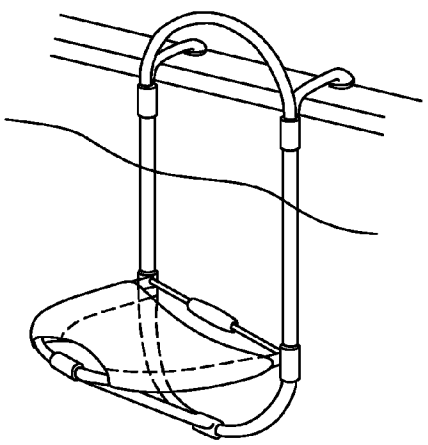
FIGS. 8A-8C illustrate alternative seat support/seat rotation restricting mechanisms usable with exemplary aquatic chair embodiments of the invention.
Figure 8B:
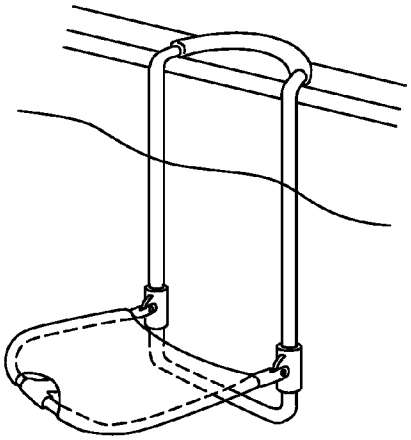
Figure 8A:
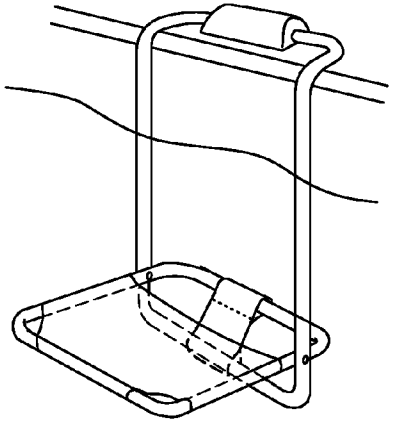

Several alternative and non-limiting mechanisms for limiting the rotation of a seat of an aquatic chair embodiment of the invention are shown in FIGS. 8A-8C. The exemplary embodiments of FIGS. 8A-8C are provided herein only for purposes of illustrating possible alternatives to the seat rotation limiting mechanisms previously described and shown, and none of the other design features also depicted are to be taken as in any way limiting the embodiments previously described and claimed below.

FIG. 8A illustrates one exemplary alternative mechanism for limiting the rotation of a seat of an aquatic chair of the invention. In this exemplary embodiment, a single strap of flexible material is connected between a rear tube of the seat frame and a bottom tube of the main frame of the aquatic chair. As shown, downward rotation of the seat frame with respect to the main frame is limited by the length of the strap. Contrarily, the flexible nature of the strap material allows the seat frame to be collapsed against or within the main frame when rotated upward.

FIG. 8B illustrates another exemplary alternative mechanism for supporting and limiting the rotation of a seat of an aquatic chair of the invention. In this exemplary embodiment, a rigid support rod is connected between a front tube of the seat frame and a bottom tube of the main frame of the aquatic chair. As shown, downward rotation of the seat frame with respect to the main frame is limited by the support rod, which transfers the weight of the seat frame and a user to the main frame. The support rod is designed such that one end thereof may be disengaged from the seat frame or main frame when desired to permit the seat frame to be collapsed against or within the main frame when rotated upward.

FIG. 8C illustrates another exemplary alternative mechanism for supporting and limiting the rotation of a seat of an aquatic chair of the invention. In this exemplary embodiment, a rigid support rod is again connected between a front tube of the seat frame and a bottom tube of the main frame of the aquatic chair. Downward rotation of the seat frame with respect to the main frame is again limited by the support rod, which transfers the weight of the seat frame and a user to the main frame. In this embodiment, however, the support rod is permanently but rotatably connected between the seat frame and the main frame. Therefore, the seat frame is made to slide along the main frame at the connection point therebetween when the seat frame is moved upward, which simultaneously causes the seat frame and the support rod to be pivotally collapsed against or within the main frame.

Aquatic chair embodiments of the invention may be provided with one or more other features or accessories—which may or may not be related to the type of use to which the chair will be subjected. One such feature is drain holes, which may be provided in one or more of the main frame, seat frame and hanging frame for facilitating the drainage of water from the aquatic chair upon removal from an aquatic body. Other features or accessories may include, without limitation, sun protection (e.g., an umbrella), comfort accessories such as arm, foot and/or head rests or a pillow, storage compartments, audio and/or video supports or connections, food and/or drink retention or support, and a beverage cooler.

Different aquatic chair embodiments according to the invention may also share one or more design characteristics. For example, the aquatic chair 105 of FIGS. 5-6 may use the support strap connection technique shown in FIGS. 1-4 or the aquatic chair 5 of FIGS. 1-4 may use the two-piece seat frame construction of the aquatic chair 105 shown in FIGS. 5-6. Alternative embodiments may employ the general design of the aquatic chair 5 of FIGS. 1-4 or the aquatic chair 105 of FIGS. 5-6, but utilize one of the alternative seat rotation limiting mechanisms of FIGS. 8A-8C. Other combinations and alterations are, of course, also possible.

What is claimed is:

1. A collapsible, hanging chair for supporting a user in a seated and partially submerged position within an aquatic body, comprising:

a substantially rectangular main frame of continuous tubular construction;

a tubular hanging frame pivotally connected to the main frame near a proximal end of the main frame, the hanging frame including a pair of tubular short legs extending substantially perpendicularly from opposite ends of a tubular long leg, with free ends of the short legs cut at the same angle as a maximum upward angle of rotation of the hanging frame with respect to the main frame;

a pair of gusset assemblies pivotally connecting the hanging frame to the main frame, each gusset assembly including a pair of gusset plates that connect the short legs of the hanging frame to the main frame;

a seat frame of continuous tubular construction pivotally connected to the main frame near a distal end of the main frame;

at least one seat frame rotation-limiting element for limiting a maximum downward angle of rotation of the seat frame with respect to the main frame; and a seat associated with the seat frame for receiving the user in the seated position;

wherein, the maximum upward angle of rotation of the hanging frame with respect to the main frame is limited by contact between free ends of the tubular short legs of the hanging frame and the main frame; and wherein the chair is supportable in the partially submerged position within the aquatic body by contact between the hanging frame and a substantially horizontally-oriented upper bounding surface surrounding the aquatic body and by contact between a rear of the seat frame and a substantially vertically-oriented wall containing the aquatic body.

2. The chair of claim 1, wherein the seat frame includes a rear seat frame section and a forward seat frame section that are joinable to form the continuous tubular construction.

3. The chair of claim 1, wherein the gusset plates allow the hanging frame to rotate with respect to the main frame, but prevent rotation of the hanging frame with respect to the gusset plates.

4. The chair of claim 1, wherein the maximum upward angle of rotation of the hanging frame with respect to the main frame is 90 degrees.

5. The chair of claim 1, wherein the seat is constructed of a material that is porous to water.

6. The chair of claim 1, wherein the seat frame rotation-limiting element is a pair of support straps that extend between and are attached to the seat frame and the main frame.

7. The chair of claim 6, wherein the support straps are attached to the seat frame and the main frame by fasteners that pass through the support straps and the frames.

8. The chair of claim 6, wherein the support straps are attached to the seat frame and the main frame by collars that encircle individual tubes of each frame and are clamped thereto by fasteners.

9. The chair of claim 1, wherein the seat frame is pivotally attached to the main frame by an elongate hinge rod that passes through both the seat frame and the main frame.

10. A collapsible, hanging aquatic chair for supporting a user in a seated and partially submerged position along a wall of a pool or spa, comprising:

a substantially U-shaped tubular main frame having an open proximal end;

a tubular hanging frame formed from a single tubular element having a long leg portion having first and second ends that curve forward at each end to form two short legs that extend substantially perpendicularly from the long lec portion;

a pair of gusset assemblies pivotally connecting the hanging frame to the main frame, each gusset assembly including a pair of gusset plates that connect the short legs of the hanging frame to the main frame;

a seat frame that includes a rear seat frame section and a forward seat frame section that are joined to form a continuous tubular structure, the seat frame pivotally connected to the main frame near a distal end of the main frame;

at least one seat frame rotation-limiting element that limits a maximum downward angle of rotation of the seat frame with respect to the main frame, but permits the seat frame to collapse against or within the main frame; and a seat associated with the seat frame for receiving the user in the seated position;

wherein, contact between free ends of the tubular short legs of the hanging frame and the main frame limits a maximum upward angle of rotation of the hanging frame with respect to the main frame, but permits the hanging frame to collapse against the main frame; and wherein the hanging frame will overlie and rest upon a deck or coping of the pool or spa and a rear portion of the seat frame will contact the wall of the pool or spa when the aquatic chair is installed thereto, such that the aquatic chair will be suspended from the pool or spa deck and the user of the chair will be supported in the seated and partially submerged position within the water of the pool or spa and along the wall thereof.

11. The chair of claim 10, wherein the seat frame is pivotally coupled to the main frame by a hinge rod that passes through both the seat frame and the main frame.

12. The chair of claim 10, wherein the gusset plates are adapted to allow the hanging frame to rotate with respect to the main frame, but prevent rotation of the hanging frame with respect to the gusset plates.

13. The chair of claim 10, wherein the seat frame rotation-limiting element is a pair of support straps that extend between and are attached to the seat frame and the main frame by collars that encircle individual tubes of each frame and are clamped thereto by fasteners.

14. A collapsible, hanging chair for supporting a user within a pool or spa, comprising:

a tubular main frame;

a tubular hanging frame for hanging the chair from a deck or coping of the pool or spa, the tubular hanging frame including a pair of tubular short legs extending substantially perpendicularly from opposite ends of a tubular long leg;

a pair of gusset assemblies pivotally connecting the hanging frame to the main frame near a proximal end of the main frame, each gusset assembly including a pair of gusset plates that connect the short legs of the hanging frame to the main frame such that the hanging frame is collapsible against the main frame when rotated in one direction and is placeable in a rotation-limited chair hanging position when rotated in an opposite direction; and a tubular seat frame having a seat portion and pivotally connected to the main frame near a distal end of the main frame, the seat frame being collapsible against or within the main frame when rotated in one direction and being placeable in a rotation-limited user supporting position when rotated in an opposite direction;

wherein, direct contact between tubular free ends of the tubular short legs of the hanging frame and the main frame limits rotation of the hanging frame when in the rotation-limited chair hanging position by limiting a maximum upward angle of rotation of the hanging frame with respect to the main frame; and wherein the chair and the user thereof are supportable in a seated and partially submerged position within the pool or spa when the aquatic chair is installed therein by contact between the hanging frame and the deck or coping of the pool or spa, and by contact between a rear of the seat frame and a wall of the pool or spa.

* * * * *